United States Patent [19]

Heald et al.

[11] Patent Number: 4,890,980

[45] Date of Patent: Jan. 2, 1990

[54] CENTRIFUGAL PUMP

[75] Inventors: Charles C. Heald, Nazareth; Trygve Dahl, Easton, both of Pa.

[73] Assignee: Ingersoll-Rand Company, Woodcliff Lake, N.J.

[21] Appl. No.: 229,256

[22] Filed: Aug. 8, 1988

[51] Int. Cl.[4] ..... F04D 29/22

[52] U.S. Cl. ..... 416/181; 416/183

[58] Field of Search ..... 416/181, 183; 415/52 R, 415/53 R

[56] References Cited

U.S. PATENT DOCUMENTS

| | | | |
|---|---|---|---|
| 2,658,455 | 11/1953 | Seinfeld | 416/181 |
| 2,753,808 | 7/1956 | Kluge | 416/181 X |
| 2,918,017 | 12/1959 | Collins | 416/181 X |
| 3,213,794 | 10/1965 | Adams | 416/181 X |
| 3,481,531 | 12/1969 | MacArthur et al. | 416/183 X |
| 3,522,997 | 8/1970 | Rylewski | 416/183 X |
| 4,778,341 | 10/1988 | Corradini et al. | 416/181 |
| 4,780,050 | 10/1988 | Caine et al. | 415/52 |

FOREIGN PATENT DOCUMENTS

| | | | |
|---|---|---|---|
| 2357305 | 5/1975 | Fed. Rep. of Germany | 416/181 |
| 72501 | 6/1979 | Japan | 416/181 |
| 225697 | 8/1968 | U.S.S.R. | 415/52 |
| 542027 | 2/1977 | U.S.S.R. | 416/181 |
| 918560 | 4/1982 | U.S.S.R. | 416/183 |
| 942648 | 11/1963 | United Kingdom | 416/181 |

*Primary Examiner*—Everette A. Powell, Jr.

*Attorney, Agent, or Firm*—D. W. Tibbott

[57] ABSTRACT

A centrifugal pump including a casing containing an impeller mounted on a shaft with a circular shroud fixed on a hub, a plurality of relatively long radial vanes fixed on the shroud and spaced around the hub at equally spaced intervals, a series of shorter vanes extending radially and spaced around the hub with at least two shorter vanes located between each pair of longer vanes, the inner end of each shorter vane being located radially outward from the inner ends of the adjacent longer vanes, each pair of adjacent longer vanes forming between them a single passage extending radially outward from the hub and flowing into at least three smaller passages formed between said pair of adjacent longer vanes and the shorter vanes located between said pair of adjacent longer vanes, and a series of oblong shaped pressure balancing holes located in said shroud and opening into said passages.

11 Claims, 2 Drawing Sheets

0364 — IR — CA
( 1 OF 2)
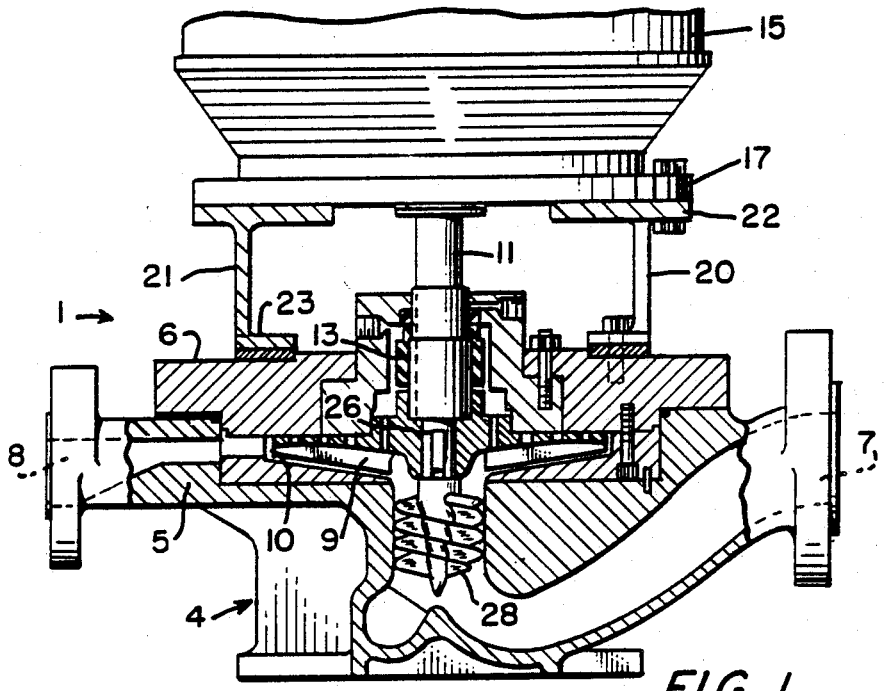
FIG. 1
FIG. 2
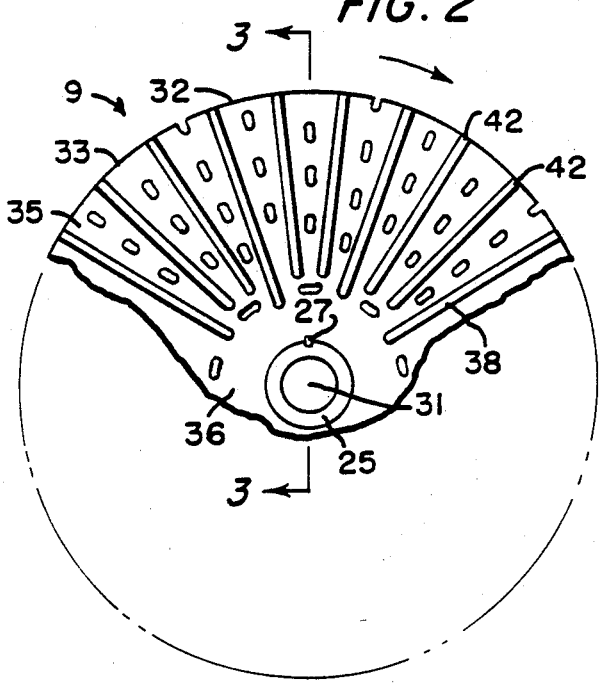
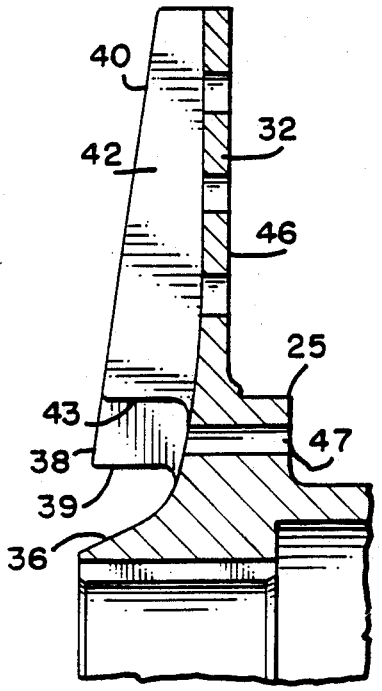
FIG. 3

0364 — IR — CA
( 2 OF 2)
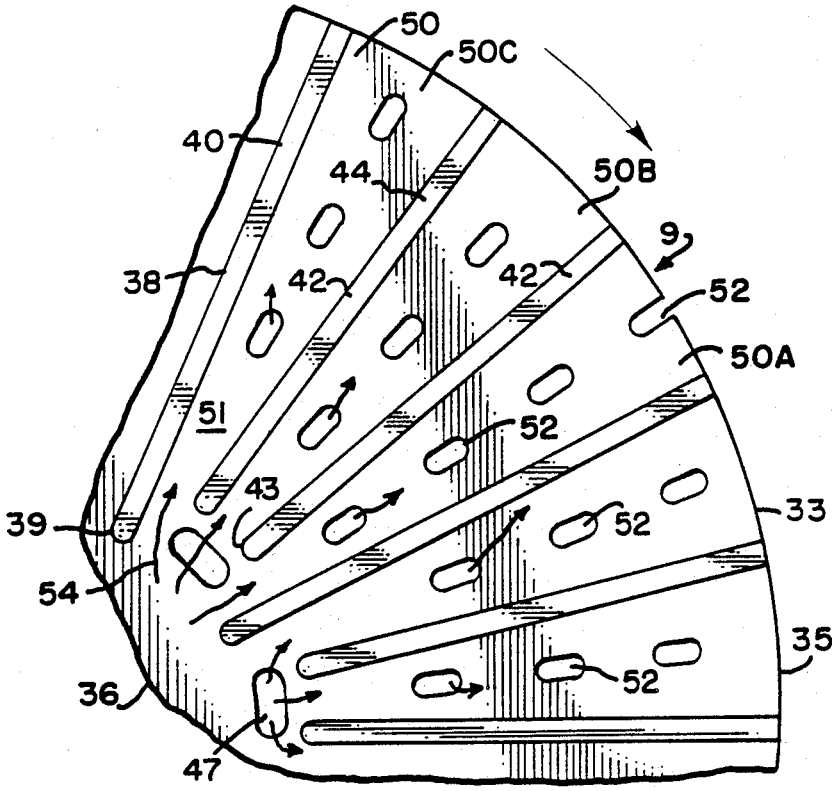
FIG. 4
FIG. 5
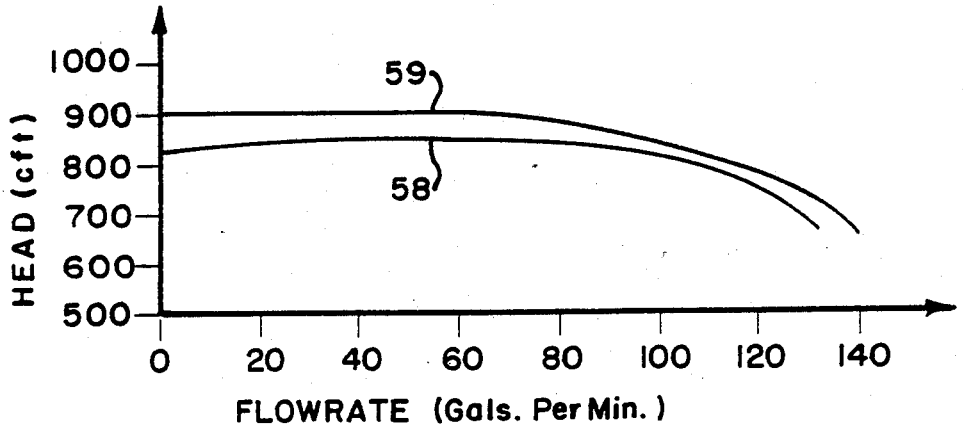

CENTRIFUGAL PUMP

BACKGROUND OF INVENTION

This invention relates to centrifugal pumps and more particularly to a centrifugal pump having an impeller with straight radially extending vanes. This type of impeller is used in applications requiring a relatively low flow and a high head of pumped liquid.

The USSR Pat. No. 918560 discloses a centrifugal pump impeller of the semi-open design having multiple radially extending vanes including a series of long vanes separated by short vanes. The short vanes are arranged in several different patterns. This patent tapers the short vanes inwardly to provide the passages between the short vanes with parallel walls giving such passages constant area sections throughout their length. In general, this is the type of pump impeller used in this invention although this invention does not include the concept of making the pumping passages of constant section along their length.

It is no usually practical to make a straight radial vane pump impeller in a fully closed design, i.e., with shrouds on both faces of the impeller, because the pump passages usually are so small that it becomes difficult to make them in a metal casting process. On the other hand, it is impractical to make this type of vane arrangement in a fully open design because there will be nothing to support the short vanes and the long vanes will be too weak to withstand the stresses present during operation. Consequently, the designer of this type of vane impeller normally provides the impeller with a semi-open design, i.e., a shroud on only one face which is normally the hub face. Providing the impeller with a semi-open design makes it easier to cast the impeller and to keep the passages clean during use, in case the material being pumped should contain debris that might clog the impeller passages.

One major problem with pump impellers of the semi-open design is that the pressure of the pumped fluid exerts a high axial thrust load on the impeller placing undesirably high loads on the bearing system for the impeller. Prior designers reduced the axial thrust on semi-open design impellers by placing pressure balancing holes in the shroud to reduce the pressure applied to the outer face of the shroud. The balancing holes were usually placed near the eye of the impeller radially inwardly of the inlets to the impeller passages because pressure balancing holes are generally more effective when placed closer to the axis of rotation and it was believed that placing balancing holes in the passages would unduly reduce the hydraulic performance of the impeller. For this reason, it is unusual for balancing holes to open into the pumping passages of an impeller.

SUMMARY OF INVENTION

An object of this invention is to provide an improved pump impeller having radial vanes of semi-open design.

Another object of this invention is to provide a pump impeller having radial vanes of semi-open design with an arrangement of pressure balancing holes that increase the hydraulic performance of such impeller compared to an impeller of the same design without balancing holes.

Another object of the invention is to provide a pump impeller having radial vanes of semi-open design and an arrangement of pressure balancing holes which can be progressively reduced in diameter over a large range of diameters progressively cutting into and eliminating part of the balancing holes while maintaining uniform hydraulic performance in the pump over the diameter range.

Another object of the invention is to provide a pump impeller having radial vanes of semi-open design which reduces the high axial thrust loads inherent in this type of pump without detrimentally effecting the overall pump performance.

BRIEF DESCRIPTION OF DRAWING

FIG. 1 is a cross-section of a pump taken along the axis of the impeller and containing an impeller made in accordance with this invention.

FIG. 2 is a face view of the impeller of FIG. 1.

FIG. 3 is a cross-section of FIG. 2 taken along the radially extending line 3—3.

FIG. 4 is an enlarged part of FIG. 2.

FIG. 5 is a graph illustrating the difference between the hydraulic performance curves of pumps using and not using this invention.

DETAILED DESCRIPTION OF INVENTION

The pump 1 shown in the drawings is a centrifugal pump and is known in the industry as a vertical in-line type of pump. The pump 1 includes a casing 4 having a casing body 5, a casing cover 6, an inlet passage 7 and an outlet passage 8 adapted to be connected to the spaced ends of a pipeline (not shown) which may support the pump 1. The pump 1 includes a centrifugal impeller 9 rotating in a pump chamber 10 formed in the casing body 5 and connected to the inlet 7 and outlet 8. The pump impeller 9 is mounted on the lower end of a shaft 11 which extends vertically upward from the impeller 9 through the casing cover 6 and is surrounded by seals 13 mounted in the casing cover 6.

The shaft 11 is a part of a driver 15, which is shown as an electric driver, mounted with the shaft 11 extending vertically downward and which includes a mounting end plate 17 surrounding the shaft 11. The mounting end plate 17 rests on and is supported on a support frame 20 located between the pump casing cover 6 and the driver 15. The support frame 20 includes several vertical legs 21 extending between a top ring 22 and a bottom ring 23. The bottom ring 23 of the support frame 20 sits on and is bolted to the casing cover 6 of pump 1 and the top ring 22 is bolted to the end plate 17 of the driver 15, resulting in the driver 15, support frame 20 and pump 1 being integrated into a single rigid unit which allows the pump to use the bearing system of the driver to support the shaft properly while it rotates in the pump casing 4 and the seals 13.

The impeller 9 includes a central hub 25 containing an axial bore receiving a reduced diameter portion 26 of the shaft 11 and is keyed to the shaft 11 by a conventional key 27 seated in corresponding keyways in the shaft portion 26 and the bore in the hub 25. The impeller 9 is held on the shaft 11 by a conventional pump inducer screw 28 having a threaded member threaded into a corresponding threaded hole in the end of the shaft 11. The inducer screw 28 rotates in an enlarged part of the inlet passage 7 for creating a positive pressure on the inlet fluid prior to it reaching the impeller 9. The inducer screw 28 can be replaced by a conventional fastener in the event the NPSH (net positive suction head) on the inlet passage 7 is sufficient. In general, the foregoing structure is conventional and forms no part of this invention except insofar as such structure is necessary for the operation of the invention.

The impeller 9 rotates about an axis 31 and includes a shroud 32 integral with the hub 25 and extending radially outward from the hub 25 with a circular periphery 33 having a radius extending from the axis 31 of the impeller 9. Looking at FIG. 3, the front face 35 of the impeller 9 includes a central eye area 36 where the axially flowing inlet fluid first meets the impeller face 35 and a curved profile for gradually turning the fluid from an axial direction to a radial direction as the inlet fluid flows radially outward. A series of long vanes 38 are integrally attached to the impeller face 35, are angularly spaced at even intervals around the impeller axis and extend on radial lines (nine are shown in FIG. 2). Each long vane 38 has an inner edge 39 starting at the edge of the eye area 36 and extends radially outwardly to the periphery 33. The front edge 40 of each vane 38 is flat and is inclined toward the shroud 32 as it extends radially outward at a small angle from a right angle plane to the axis 31. The front edges 40 of all long vanes 38 lie in the surface of an imaginary cone having its apex on the axis 31 of the impeller 9 and diverging toward the shroud 32 as the cone extends radially toward the periphery 33.

A pair of short vanes 42 are integrally attached to the impeller front face 35 between each pair of adjacent long vanes 38, extend on radial lines and are evenly spaced from themselves and the adjacent long vanes 38. The inner edges 43 of the short vanes 42 are located at a substantial distance radially outward from the inner edges 39 of the long vanes 38 and extend outward to the periphery 33 of the impeller 9. The front edges 44 of the short vanes 42 are located in the surface of the same imaginary cone as in the case of the front edges 40 of the long vanes 38. One reason for this location of the front edges 40 and 44 of both the long and short vanes is because these edges have to rotate in proximity to the adjacent walls of the pump chamber 10 in order to pump efficiently. Another reason is because these edges are arranged to be planed (cut by machine tool) to change the size of the pump impeller enabling the same size of impeller casting to be used for different sizes of pumps. This invention also enables the machining of the periphery 33 of the impeller casting to provide a series of different diameter impellers 9 which will be further explained later.

The impeller 9 is a semi-open type since it has only a single shroud 32. This type of impeller causes the creation of a large thrust force on the rear face 46 of the impeller because the outlet pressure of the pumped fluid flows into the space adjacent the rear face 46 and the pressure on the front face 35 of the impeller is not sufficient to create a counter force of similar magnitude such as would be the case with a closed impeller (having two shrouds). One way of reducing this large thrust force is by placing pressure balancing holes 47 in the impeller 9 adjacent the central eye area 36. The pressure fluid acting on the rear face 46 flows through the holes 47 and joins the inlet fluid as it is pumped. Proper sizing and placement of the holes 47 adjacent to the eye area 36 does not unduly reduce the efficiency of the pump while aiding in reducing the pressure of the fluid acting on the the rear face 46.

The use of the long vanes 38 with the short vanes 42 provides a series of radially directed pump passages 50. The area between each pair of long vanes 38 is characterized as a sector 51 and the three passages 50 in each sector 51 are further divided into a leading passage 50A, an intermediate passage 50B, and a trailing passage 50C, with these names being selected in accordance with the direction of rotation of the impeller 9 as shown by the arrow in FIGS. 2 and 4.

This invention includes the concept of placing additional small pressure balancing holes 52 in the shroud 32 between the passages 50 and the rear face 46 of the shroud 32. These holes 52 allow further fluid under pressure to flow from the space adjacent the rear face 46 to join the fluid being pumped in the passages 50, causing further reduction of pressure acting on the rear face 46 and, to the surprise of the inventors, increasing the efficiency of the pumping operation, as will be explained.

As seen in FIG. 2, the impeller 9 is rotating in the clockwise direction and as the pumped fluid enters the eye area 36 it is swept radially outward which in conjunction with the rotation of the impeller causes a resultant motion of a clockwise spiraling of the fluid. Initially the fluid enters a sector 51 between two adjacent long vanes 38 and continues to spiral to the left, relative to the clockwise rotating impeller, as shown in FIG. 5 by the arrows 54. This resultant spiraling motion of the fluid causes more fluid to enter the trailing passage 50C than enters the intermediate passage 50B and still less fluid to enter the leading passage 50A. Since there is less fluid flowing in the leading passage 50A, the small balance holes 52 in the leading passage 50A are located closer to the eye area 36 than the small holes 52 in the other two passages 50B and 50C in order for the fluid on the rear face 46 to increase the amount of fluid in the leading passage 50A sooner, i.e. closer to the eye area 36, than in the other two passages. Likewise, the small balance holes 52 in the intermediate passage 50B are located closer to the eye area 36 than the holes 52 in the trailing passage 50C for the same reason, namely for the fluid flowing through the holes 52 to join the pumped fluid in the intermediate passage 50B sooner than in the trailing passage 50C.

The small pressure balancing holes 52 in each sector 51 are further arranged in the passages at equally spaced intervals along the passages 50 with the holes in each passage 50 at a different distance from the axis 31 as compared to the other holes 52 in the group of holes in that sector of passages 51. One reason for this arrangement is to spread the pressure balancing holes uniformly along the radius of the impeller 9 in each section 51 in order to more uniformly relieve the pressure on the rear face 46 of the impeller shroud 32. Another reason is so that the pressure balancing holes 52 continue to be spread uniformly across the rear face 46 as the impeller periphery 33 is reduced by machining as will be explained later.

Another factor to be taken into account in determining the arrangement of the small pressure balancing holes 52 is the need to have the same number of pressure balancing holes 52 opening on the periphery 33 as the radius of the impeller is reduced. In the arrangement shown in FIG. 2, each sector 51 has one small hole 52 on the periphery throughout the reduction of the periphery 33. This means that as the radius of the impeller 9 is increased starting from the hole 52 nearest the eye area 36 in each sector 51, one hole 52 per sector 51 will always lie on a circle generated at any radius until reaching the periphery 33.

If the small holes 52 were round, there would be many more holes in the passages 50 than shown in order to meet this requirement of always having one hole per sector on a generated circle at any radius. The use of the oblong holes 52 has reduced the number of holes necessary to meet this condition of always having at least one hole on the generated circle. Fewer holes means that the strength of the impeller is affected to a lesser degree that if the holes were round. In fact, the use of round holes might reduce the strength of the impeller 9 to the point that it would be dangerous, and thus unacceptable. All of this makes it obvious that the use of elongated holes is one of the features of this invention.

The centrifugal pump impeller 9 having straight radially extending vanes has a relatively low specific speed normally located in the range below 600 (see formula for specific speed below). This relatively low specific speed range means that it is a relatively low flow pump capable of producing high head coefficients and has a relatively low efficiency. This type of pump is used in applications that require the production of high heads while pumping a relatively small amount of pumped fluid and a high efficiency is not a high priority. Designing a pump is normally a compromise between the different qualities desired in the pump and, generally, the application for the subject pump is when obtaining a high head at a relatively low pump cost is one of the more important considerations.

The formula for specific speed used herein is:

Specific Speed $=N\sqrt{Q}/H^{\frac{3}{4}}$

Wherein:

N=impeller speed (rpm)

Q=flowrate (gpm)

H=head (ft)

The general design parameters for the pump of this invention include the following:

speed: 3550 rpm
flowrate: 16 to 125 gpm
total developed head: 250 to 750 ft.
max suction pressure: 500 psi
max casing work pressure: 720 psi
NPSH without induce: 4 to 10 ft
NPSH with inducer: 2 ft
temperature: −65 to 500 deg F.
impeller diameter: 6 to 12 inches FIG. 5 is a graph in which the vertical coordinate measures the total developed head in feet and the horizontal coordinate measures the rate of flow in gals. per minute. The curve 58 was taken at constant speed for a pump containing the impeller 9 minus the small pressure balancing holes 52 and the curve 59 was taken for the same pump at the same constant speed with an impeller 9 containing the small pressure balancing holes 52. It should be noted that the curve 59 has a higher head at the same flow rate than the curve 58 indicating that the small pressure balancing holes 52 increase the head capability of the pump with no loss in overall pump efficiency which was surprising.

The specifications of the pumps used to produce the graph of FIG. 5 included a 12 inch impeller having 27 vanes with each long vane followed by two shorter vanes, the speed was 3550 rpm, the NPSH was 4 ft, no inducer was used, and the pumped fluid was 80 deg F. water.

While only one embodiment of this invention is shown and described in detail, this invention is not limited merely to the specifically described embodiment, but contemplates other embodiments and variations utilizing the concepts and teachings of this invention.

We claim:

1. A centrifugal pump comprising: a centrifugal pump casing including an impeller chamber connected between an inlet and an outlet; a shaft mounted in said casing and adapted to be driven; an impeller located in said chamber and mounted on said shaft; said impeller including a central hub mounted on the shaft, a circular shroud fixed on the hub having a circular periphery axially aligned with the axis of the hub, a plurality of relatively long vanes fixed on the shroud and spaced around the hub at equally spaced intervals, a series of shorter vanes extending radially and spaced around the hub with at least one shorter vane located between each pair of longer vanes, the inner end of each shorter vane being located radially outward from the inner ends of the adjacent longer vanes, each pair of adjacent longer vanes forming between them a single passage extending radially outward from the hub and flowing into a plurality of smaller passages formed between said pair of adjacent longer vanes and bordered on at least one side by at least one shorter vane located between said pair of adjacent longer vanes, and a series of pressure balancing holes located in said shroud and opening into said passages.

2. The centrifugal pump of claim 1 wherein the majority of pressure balancing holes open into the smaller passages.

3. The centrifugal pump of claim 2 wherein said pressure balancing holes are non-circular in cross-section.

4. The centrifugal pump of claim 3 wherein said pressure balancing holes are oblong-in cross-section.

5. The centrifugal pump of claim 4 wherein the major diameter of each of said oblong pressure balancing holes extends radially.

6. The centrifugal pump of claim 1 wherein there is a series of pressure balancing holes in each of said smaller passages located at radially spaced positions along said passage.

7. The centrifugal pump of claim 6 wherein said pressure balancing holes in each series in each passage are located with substantially the same spacing between adjacent holes.

8. The centrifugal pump of claim 7 wherein said pump is made for the pump impeller to rotate in a given direction and the smaller passages formed between each pair of longer vanes includes a leading passage which leads the other passages between such pair of longer vanes with respect to the direction of rotation of said pump impeller and with the series of balancing holes in such leading passage beginning at a location that is radially closer to the impeller axis than the series of pressure balancing holes in the other passages located between said pair of longer vanes.

9. The centrifugal pump of claim 8 wherein the pressure balancing holes are located uniformly along said passages in an arrangement to allow the periphery of the impeller to be machined to a smaller diameter while only one pressure balancing hole between each pair of longer vanes opens into the periphery of the impeller.

10. A centrifugal pump comprising: a centrifugal pump casing including an impeller chamber connected between an inlet and an outlet; a shaft mounted in said casing and adapted to be driven; an impeller located in said chamber and mounted on said shaft; said impeller including a central hub mounted on the shaft, a circular shroud fixed on the hub having a circular periphery axially aligned with the axis of the hub, a plurality of relatively long vanes fixed on the shroud and spaced around the hub at equally spaced intervals, a series of shorter vanes extending radially and spaced around the hub with at least two shorter vanes located between each pair of longer vanes, the inner end of each shorter vane being located radially outward from the inner ends of the adjacent longer vanes, each pair of adjacent longer vanes forming between them a single passage extending radially outward from the hub and flowing into at least three smaller passages formed between said pair of adjacent longer vanes and bordered on at least one side by at least one shorter vane located between said pair of adjacent longer vanes, and a series of pressure balancing holes located in said shroud and opening into said passages.

11. The centrifugal pump of claim 1 wherein the vanes are arranged for the passages to diverge as they extend radially outward.

* * * * *